United States Patent [19]

Oprean

[11] 4,071,236

[45] Jan. 31, 1978

[54] SWIMMER'S DRAG SUIT

[76] Inventor: George Oprean, 26 Chili Ave., Scottsville, N.Y. 14546

[21] Appl. No.: 673,377

[22] Filed: Apr. 5, 1976

[51] Int. Cl.[2] ..... A63B 69/00

[52] U.S. Cl. ..... 272/116; 2/67; 272/99

[58] Field of Search ..... 9/301, 303; 272/71, 272/99, 119, 93, 1 B, 100, 116; 244/143; 2/79, 247, DIG. 1, 67; 35/29 B; 61/70

[56] References Cited

U.S. PATENT DOCUMENTS

| | | | |
|---|---|---|---|
| 2,104,145 | 1/1938 | Abel | 2/79 |
| 2,982,105 | 5/1961 | Akers | 61/70 |
| 3,135,098 | 6/1964 | Root | 2/247 |
| 3,334,357 | 8/1967 | Stults | 2/247 |
| 3,364,616 | 1/1968 | Speers | 61/70 |
| 3,584,870 | 6/1971 | Garst | 9/303 X |

*Primary Examiner*—Trygve M. Blix
*Assistant Examiner*—Sherman D. Basinger
*Attorney, Agent, or Firm*—Bruns & Jenney

[57] ABSTRACT

A training device for competitive swimmers in the form of a drag suit adapted to be worn over the swimmer's regular suit. The drag suit adds weight and increases the resistance (drag) to the swimmer's movement through the water and thus helps in the development of the swimming muscles. The increased drag is caused by a plurality of pockets on the front and back of the suit which pockets open in the direction of the swimmer's movement through the water. Water entering the pockets is impeded in flowing through them whereby the drag is created. The pockets are located on the suit in such a manner that the drag is distributed evenly on the swimmer with no imbalance tending to cause the swimmer to roll or dip.

7 Claims, 6 Drawing Figures

SWIMMER'S DRAG SUIT

BACKGROUND OF THE INVENTION

This invention relates generally to athletic training devices, and has particular reference to a novel drag suit for swimmers training for competition.

In training competitive swimmers, it has been recognized that the development of the swimming muscles ranks in importance with the swimmer's technique and wind conditioning. One method of development that has been advocated is weight lifting but this is not completely satisfactory because the muscular development does not really correspond to that required for swimming. At the present time, many coaches believe that a more appropriate way to develop swimming muscles is to increase the weight that the swimmer must carry and/or the resistance to his movement through the water while actually swimming laps during training. This strengthens the swimming muscles and the swimmer's endurance and thus improves his competitive ability.

Heretofore, swimmers have added weight and increased drag during practice sessions by wearing several T-shirts and shorts or cut off jeans over their regular suits. This means that extra garments must be carried to practices and extra wet garments must be carried back home. Increasing weight and drag by wearing additional garments can also have the disadvantage of distributing the added weight and drag unevenly on the swimmer which can increase the tendency for his body to roll or dip.

As an alternative to wearing extra garments during training, various mechanical attachments have been proposed for swimmers such as those shown in U.S. Pat. Nos. 3,142,485; 3,517,930 and 3,584,870. The devices disclosed in the first two patents are somewhat cumbersome and awkward and do not distribute the drag evenly over the swimmer's body. The pocket attachment disclosed in the third patent, which is the closest prior art known to the applicant, also fails to distribute the drag evenly and has the further disadvantage that it can slip out of position and throw the swimmer out of balance.

SUMMARY OF THE INVENTION

The drag suit of the present invention is adapted to fit snuggly over the wearer's regular swim suit and is preferably made of a nylon tricot mesh material that is commercially available. The suit is provided on its front and back sides with a plurality of drag creating pockets made of the same material as the suit and arranged so as to be symmetrical with respect to the centerline of the suit. Thus, there are two pairs of pockets on each side that are located so that one pair is at the upper part of the swimmer's torso and the other pair is at the lower part. In addition, the back has a single, centrally disposed pocket that is located so as to be approximately between the swimmer's shoulder blades, the single pocket operating as a stabilizer for the swimmer.

Each of the pockets is disposed so that it is open in the direction of the swimmer's movement through the water whereby the water readily enters the pockets. Entry of the water into the pockets is aided by means which normally hold them in open or expanded position. Each pocket is formed with pleats at its sides that are arranged so that in open position the pocket tapers inwardly from top to bottom. All of this impedes the flow of the water through the pockets thereby creating the desired drag.

DESCRIPTION OF THE PREFERRED EMBODIMENT

Figure 6:
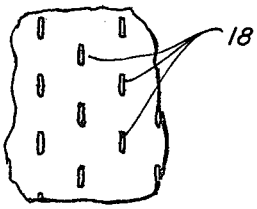
FIG. 6 is a fragmentary, detail view showing a piece of the cloth from which the suit and pockets are made.

With reference now to the drawings, 10 generally indicates the drag suit which is a torso covering garment having a neck opening 12 and arm and leg holes 14 and 16, respectively. The suit and the pockets, to be described, are fabricated from a commercially available nylon tricot mesh cloth that has a multiplicity of small, uniformly spaced holes 18 as is best shown in the FIG. 6 detail. The drag suit 10 is adapted to fit snuggly over the wearer's regular swim suit and is provided with a zipper 20 on its front side to make it easy to step into the suit when putting it on. It is contemplated that the suit will be produced in three or four standard sizes such as S, M, L and XL, and that suits of the same basic design will be worn by both male and female swimmers.

In accord with the invention the front and back of the suit 10 are provided with drag creating pockets, there being an upper pair 22 and lower pair 24 on the front of the suit and corresponding upper and lower pairs 26,28 on the back of the suit. The four pairs of pockets are, as shown, symmetrically arranged with respect to the longitudinal centerline of the suit so that the drag forces are uniformly distributed over the swimmer's body. On the back of the suit there is an additional, centrally disposed pocket 30 which is located so that it is approximately between the swimmer's shoulder blades. This single pocket operates as a stabilizer and helps to reduce body roll.

Figure 1:
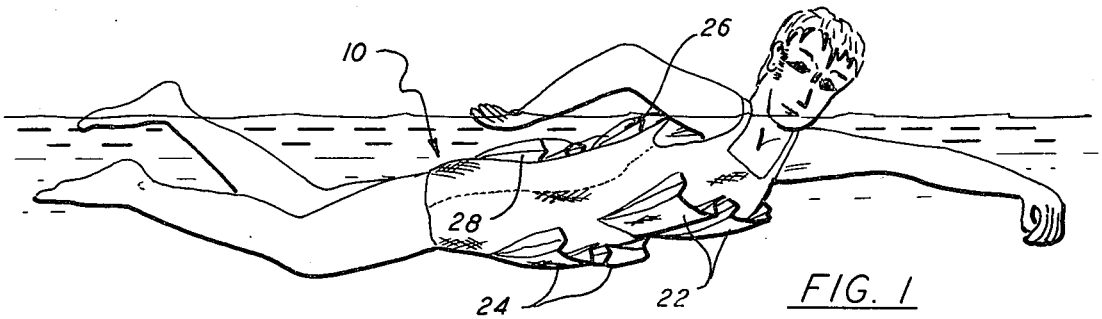
FIG. 1 is a view of a swimmer wearing the drag suit of the invention.
Figure 2:
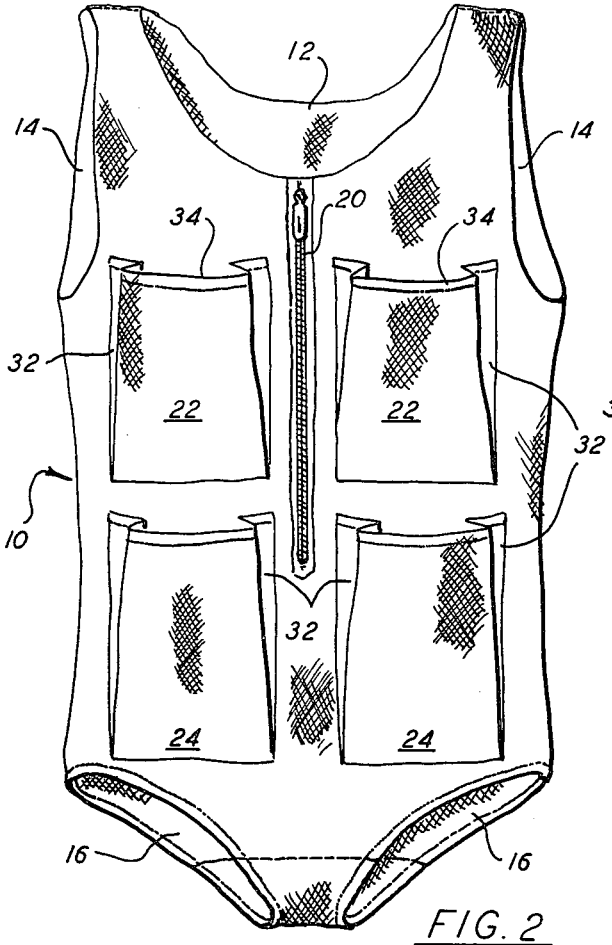
FIG. 2 is an enlarged front elevation of the suit.
Figure 3:
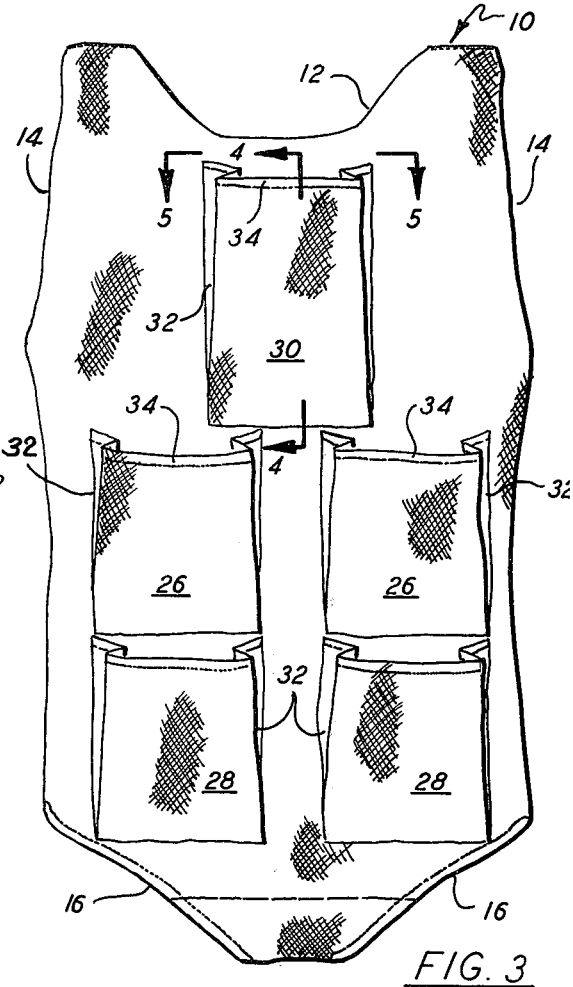
FIG. 3 is an enlarged rear elevation of the suit.
Figure 4:
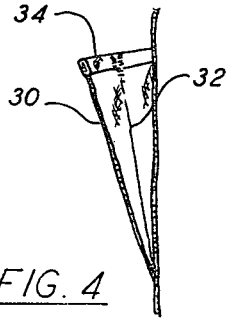
FIG. 4 is a vertical section through one of the drag creating pockets taken on line 4—4 of FIG. 3.
Figure 5:
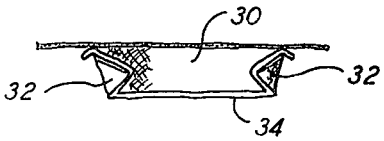
FIG. 5 is a fragmentary horizontal section looking down on a pocket opening, the section being taken on line 5—5 of FIG. 3.

The bottom and side edges of each pocket are secured to the suit 10 by sewing, leaving the top open. The pockets thus open in the direction of the swimmer's movement through the water, see FIG. 1, whether the swimmer is swimming on his stomach or his back. The pockets are formed with pleats 32 adjacent the side edges thereof, the pleats being arranged so that in open position the pockets taper inwardly from top to bottom as best shown in FIGS. 4 and 5. With this construction, the pockets function like scoops but the water scooped in is thereafter subjected to a funneling effect due to the tapers whereby drag is created.

The drag creating pockets are normally held in open or expanded position by relatively stiff strips of elastic material that is incorporated into the upper edges 34 of the pockets. This insures that the lower or rearward pockets 24,28 will not be collapsed by water passing through the pockets above them, and also insures that the pockets will be open when the swimmer enters the water and after he has made his turns. However, if a pocket is hit by the swimmer's arm, it will simply collapse and then refill. Similarly, the pockets may discharge water on turns and then refill.

From the foregoing description it will be apparent that the invention provides a novel and very advantageous drag suit for swimmers training for competition. As will be understood by those familiar with the art, the invention may be embodied in other specific forms without departing from the spirit or essential characteristics thereof.

I claim:

1. A drag suit for a swimmer training for competition, the suit covering the swimmer's torso only, the suit having as an integral part thereof at least one drag creating pocket on both its front and back sides, the front and back pockets having substantially the same construction, each pocket being secured to the drag suit at its bottom and side edges only and including means for normally holding an upper edge of the pocket away from the suit whereby the pocket operates as a scoop when the swimmer moves through the water.

2. A drag suit as defined in claim 1 wherein the pockets are constructed so that water can flow through them.

3. A drag suit as defined in claim 1 wherein the pockets are made of cloth having a multiplicity of small openings therein.

4. A drag suit as defined in claim 1 wherein there are a plurality of pockets on both the front and back sides of the suit, the pockets on each side being symmetrical with respect to the centerline of the suit.

5. A drag suit as defined in claim 4 wherein there are a plurality of pairs of symmetrically arranged pockets on the front and back of the suit, the back also having a centrally disposed pocket located so as to be approximately between the shoulder blades of the suit wearer.

6. A drag suit for adding weight and drag to a swimmer training for competition, the suit covering only the torso of the swimmer, the suit including a plurality of drag creating pockets on both its front and back sides, the suit and pockets being made of cloth having a multiplicity of small openings therein, the pockets on each side of the suit being symmetrical with respect to the centerline of the suit, each pocket being secured to the drag suit at its bottom and side edges only and including means for normally holding an upper edge of each pocket away from the suit whereby the pocket operates as a scoop when the swimmer moves through the water.

7. A drag suit as defined in claim 6 wherein there are a plurality of pairs of symmetrically arranged pockets on the front and back of the suit, the back also having a centrally disposed pocket located so as to be approximately between the shoulder blades of the suit wearer.

* * * * *